US011833403B2

(12) United States Patent
Kibbe et al.

(10) Patent No.: US 11,833,403 B2
(45) Date of Patent: Dec. 5, 2023

(54) BAT SWING TRAINING DEVICE

(71) Applicant: MAGIC SPORTS, LLC, Ames, IA (US)

(72) Inventors: Robert Nicholas Kibbe, Ames, IA (US); Grant David Roepsch, Cozard, NE (US); Aaron Matthew Tjaden, Cedar Rapids, IA (US); Ryan Patrick McGuire, Ames, IA (US)

(73) Assignee: MAGIC SPORTS, LLC, Ames, IA (US)

( * ) Notice: Subject to any disclaimer, the term of this patent is extended or adjusted under 35 U.S.C. 154(b) by 0 days.

(21) Appl. No.: 17/085,624

(22) Filed: Oct. 30, 2020

(65) Prior Publication Data

US 2021/0046367 A1 Feb. 18, 2021

Related U.S. Application Data

(63) Continuation-in-part of application No. 16/273,915, filed on Feb. 12, 2019, now Pat. No. 10,857,442.

(60) Provisional application No. 62/643,566, filed on Mar. 15, 2018.

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2225/055* (2013.01); *A63B 2225/093* (2013.01)

(58) Field of Classification Search
CPC ..... A63B 69/0075; A63B 69/0002; A63B 2069/0008; A63B 2225/055; A63B 2225/093
USPC ..... 473/417, 422
See application file for complete search history.

(56) References Cited

U.S. PATENT DOCUMENTS 2,377,010 A * 5/1945 Howard ..... F16L 33/213 285/258
3,940,132 A * 2/1976 Lopatto, III ..... A63B 69/385 473/418
4,145,044 A * 3/1979 Wilson ..... A63B 63/083 473/483
4,161,313 A * 7/1979 Dickey ..... A63B 69/0071 273/DIG. 30
4,352,494 A * 10/1982 Wells ..... A63B 69/0075 473/449
5,586,360 A * 12/1996 Diederiks, Jr. ..... E04D 13/0765 15/410
6,443,859 B1 * 9/2002 Markin ..... A63B 69/406 124/78
6,766,560 B2 * 7/2004 Murphy ..... A47L 9/327 15/344
7,614,600 B1 * 11/2009 Smith ..... G09F 23/00 248/910
7,846,045 B1 * 12/2010 Kendall ..... A63B 69/0075 473/422
7,980,966 B2 7/2011 Tell et al.
(Continued)

*Primary Examiner* — Mitra Aryanpour
(74) *Attorney, Agent, or Firm* — Dentons Davis Brown; Matthew Warner-Blankenship

(57) ABSTRACT

A bat swing training device has a base assembly, an arm assembly adjustably connected to the base assembly, and a suction assembly that extends through and out of the arm assembly to hold a ball in a stationary position. The suction assembly includes a coil hose connected to a pump, and an upper hose connected to the coil hose at one end, and removably connected to a nozzle assembly at an opposite end.

1 Claim, 12 Drawing Sheets

(56) References Cited

U.S. PATENT DOCUMENTS

| | | | | |
|---|---|---|---|---|
| 8,425,352 | B1 * | 4/2013 | Loduca | A63B 69/38 473/418 |
| 8,739,362 | B1 * | 6/2014 | Conder | B08B 5/02 15/406 |
| 9,352,204 | B2 | 5/2016 | Gardner et al. | |
| 10,405,712 | B2 * | 9/2019 | Collar | A47L 9/246 |
| 10,497,278 | B2 * | 12/2019 | Loduca | G09B 19/0038 |
| 10,857,442 | B2 * | 12/2020 | Kibbe | A63B 71/023 |
| 2002/0198068 | A1 * | 12/2002 | Jordan | A63B 69/0002 473/418 |
| 2003/0064836 | A1 | 4/2003 | Moss et al. | |
| 2005/0003908 | A1 | 1/2005 | Smull et al. | |
| 2010/0304900 | A1 | 12/2010 | Gu | |
| 2013/0085020 | A1 * | 4/2013 | Loduca | A63B 69/0002 473/418 |
| 2015/0343289 | A1 | 12/2015 | Gardner et al. | |
| 2018/0369673 | A1 * | 12/2018 | Flora | A63B 69/0075 |
| 2019/0282876 | A1 * | 9/2019 | Kibbe | A63B 69/0075 |
| 2021/0046367 | A1 * | 2/2021 | Kibbe | A63B 69/0002 |

* cited by examiner

BAT SWING TRAINING DEVICE

CROSS REFERENCE TO RELATED APPLICATION

This application is a continuation-in-part of pending application Ser. No. 16/273,915 filed Feb. 12, 2019, which claims the benefit of priority of Provisional Application No. 62/643,566 filed Mar. 15, 2018, the priority and contents of these applications are hereby incorporated by reference in their entirety.

BACKGROUND OF THE INVENTION

The present invention is directed to a bat swing training device. More particularly, the present invention is directed to a bat swing training device that assists in developing proper swing mechanics for a baseball bat, softball bat, or the like.

Devices for developing bat swings are known in the art. Most common is a baseball tee having a base, a vertical shaft that extends vertically from the base, and a support connected to the top of the shaft to receive and support a ball. These batting tees encourage poor swing mechanics. Because the ball sits on top of the tee, a proper swing, where the ball is struck on a lower portion, is impeded by the bat making contact with the shaft of the tee, including the top of the shaft or a cup atop the shaft.

Other devices, where the ball is hung from above do not solve this problem. In one example, in order to hold the ball, the device has a retaining member that covers at least half the ball, restricting visibility of the upper portion of the ball. Another device that uses vacuum pressure is designed to move the ball through a hitting zone to develop hand eye coordination and not swing mechanics.

Ideal swing mechanics involve hitting the ball on the bottom third portion with a range of an approximately seventeen to thirty-five degree launch angle. Needed in the art is a bat swing training device where the ball is almost completely visible to encourage proper swing mechanics where the bottom of the ball is unimpeded by the tee and allows the ball to be cleanly hit, driving through the ball with a more mechanically sound swing by providing an almost completely visible stationary target. Through repetition, one develops muscle training and muscle memory for proper swing mechanics.

An objective of the present invention is to provide a bat swing training device where the ball is stationary and almost completely visible.

Another objective of the present invention is to provide a bat swing training device that develops proper swing mechanics.

Yet another objective of the present invention is to provide a bat swing training device that functions the same with various ball types, materials, wear, and finishes.

Another objective of the present invention is to provide a bat swing training device that can alter the position of the ball without disassembling the device.

Yet another objective of the present invention is to provide a bat swing training device that allows a ball to follow a natural flight path when hit from the device Another objective of the present invention is to provide a bat swing training device that allows cleaner contact with a ball.

Yet another objective of the present invention is to provide a bat swing training device that is portable and operates in a standalone fashion.

Another objective of the present invention is to provide a bat swing training device that is stable and does not require weights to hold the base assembly in place.

These and other objectives will be apparent to one having ordinary skill in the art based on the following written description, drawings and claims.

SUMMARY OF THE INVENTION

A bat swing training device achieves the stated objectives by suspending a ball with suction force in a near completely visible manner, naturally encouraging better batting swing mechanics where a batter is more likely to cleanly hit the bottom of the ball, driving through it in a more mechanically sound swing.

Problems in other devices are solved via a self-contained system that provides a constant source of vacuum suction to suspend the ball. The constant source of optimal amount of vacuum pressure permits use of a minimal contact patch or suction cup to connect the ball to the suction assembly. This arrangement permits the ball to be almost completely visible to the user giving them a more realistic view of the ball.

The device is also portable having a base assembly that enclose a battery assembly and a pump assembly. An adjustable arm assembly is connected to the base assembly and a suction assembly extends from the base assembly through the arm assembly. The suction assembly includes a coil hose connected to the pump at one end and an upper hose at the opposite end. The upper hose is connected to a nozzle assembly that extends out of the arm assembly and holds a ball with suction force.

DETAILED DESCRIPTION

Figure 1:
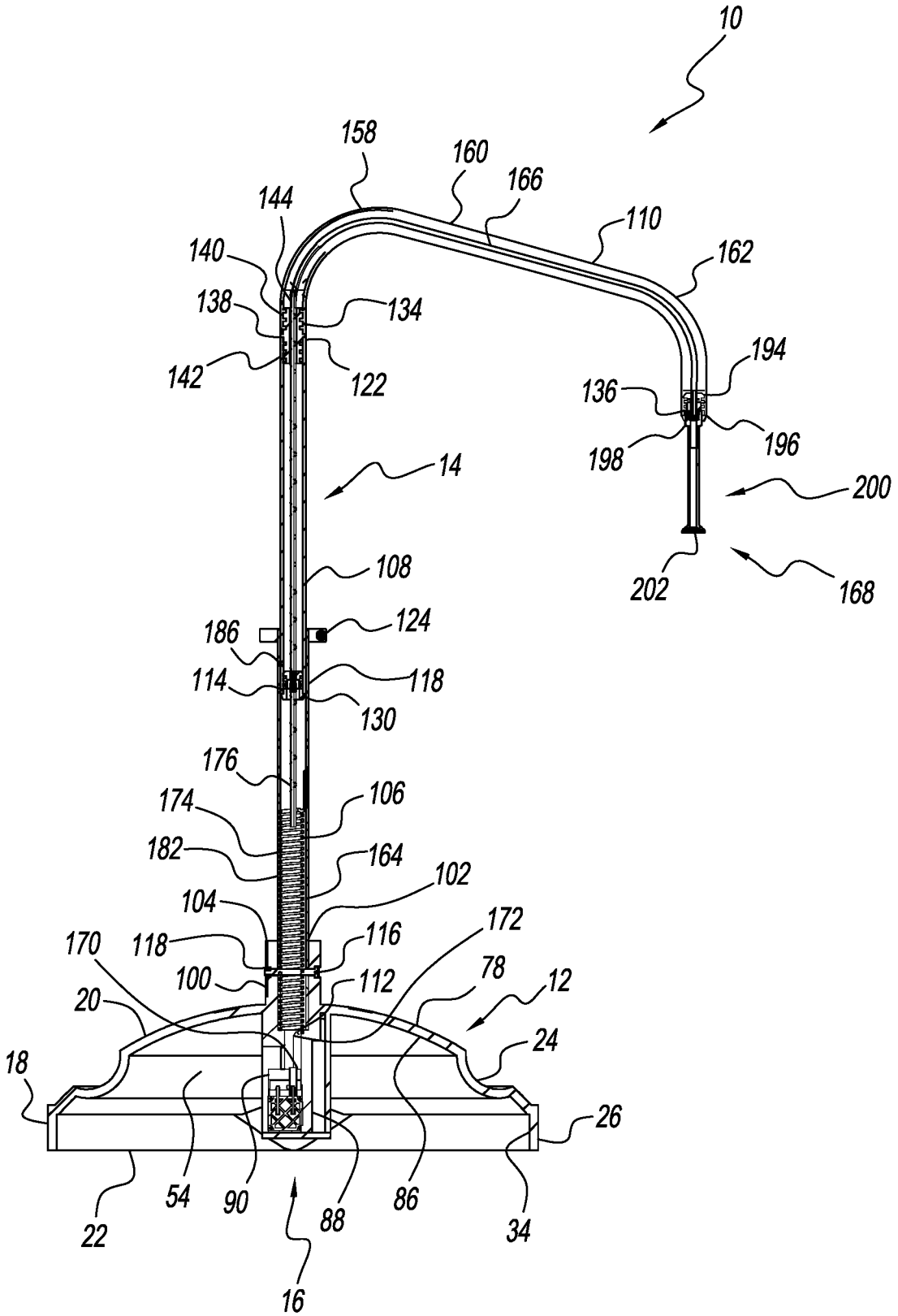
FIG. 1 is a side sectional view of a bat swing training assembly.
Figure 2:
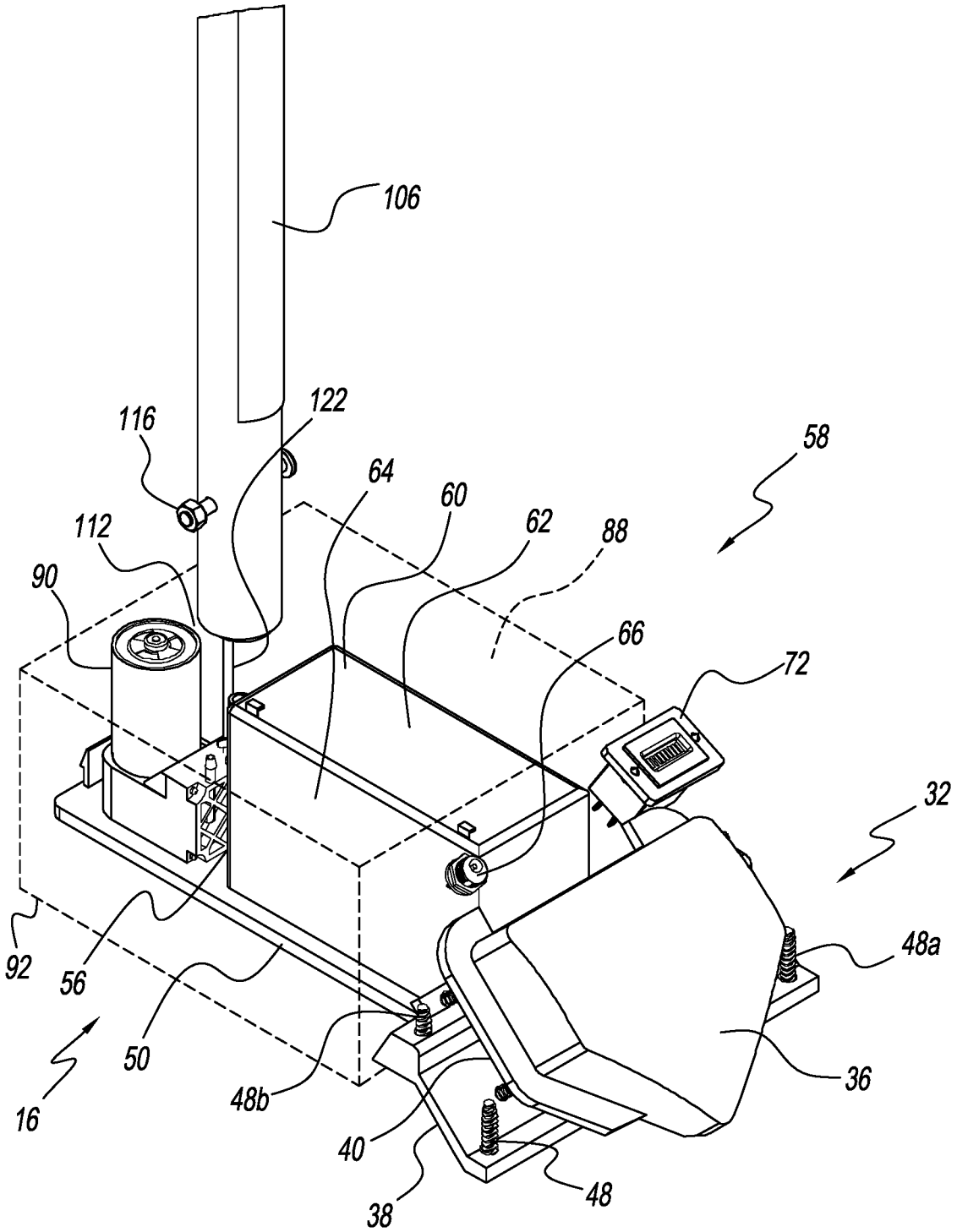
FIG. 2 is a perspective view of a portion of a bat swing training device.
Figure 3:
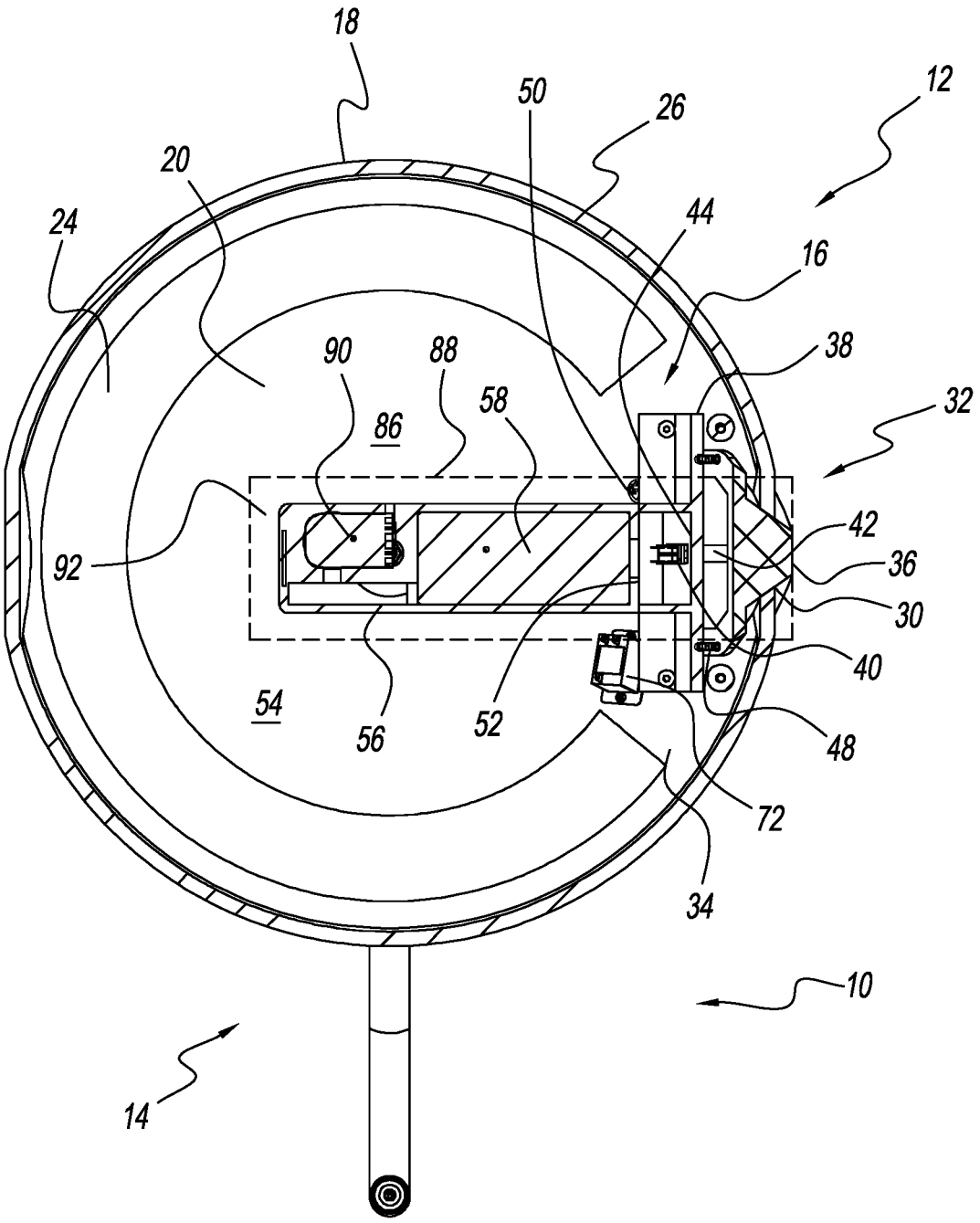
FIG. 3 is a bottom plan sectional view of a bat swing training device.
Figure 4A:
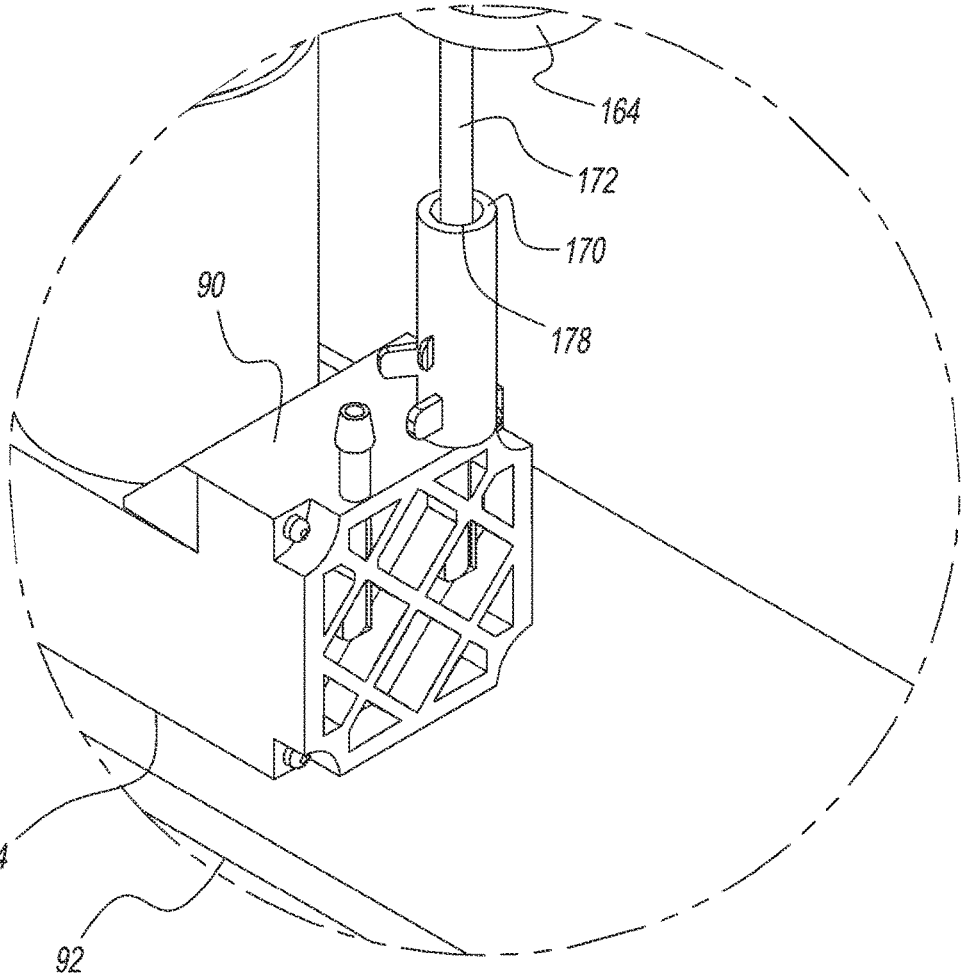
FIG. 4A is a perspective view of a portion of the suction assembly for a bat swing training device of FIG. 4B.
Figure 4B:
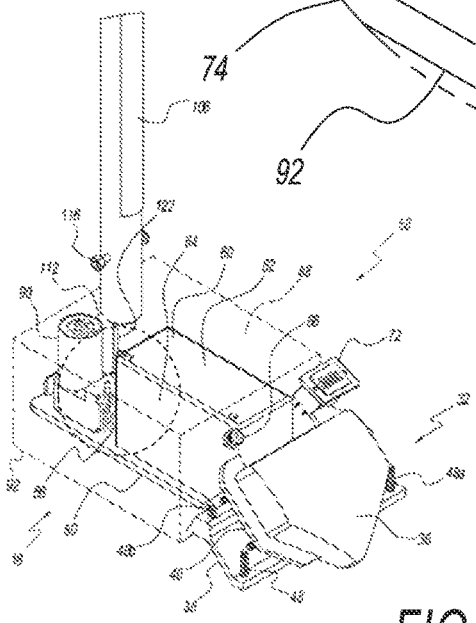
FIG. 4B is a perspective view of a portion of a bat swing training device.
Figure 5:
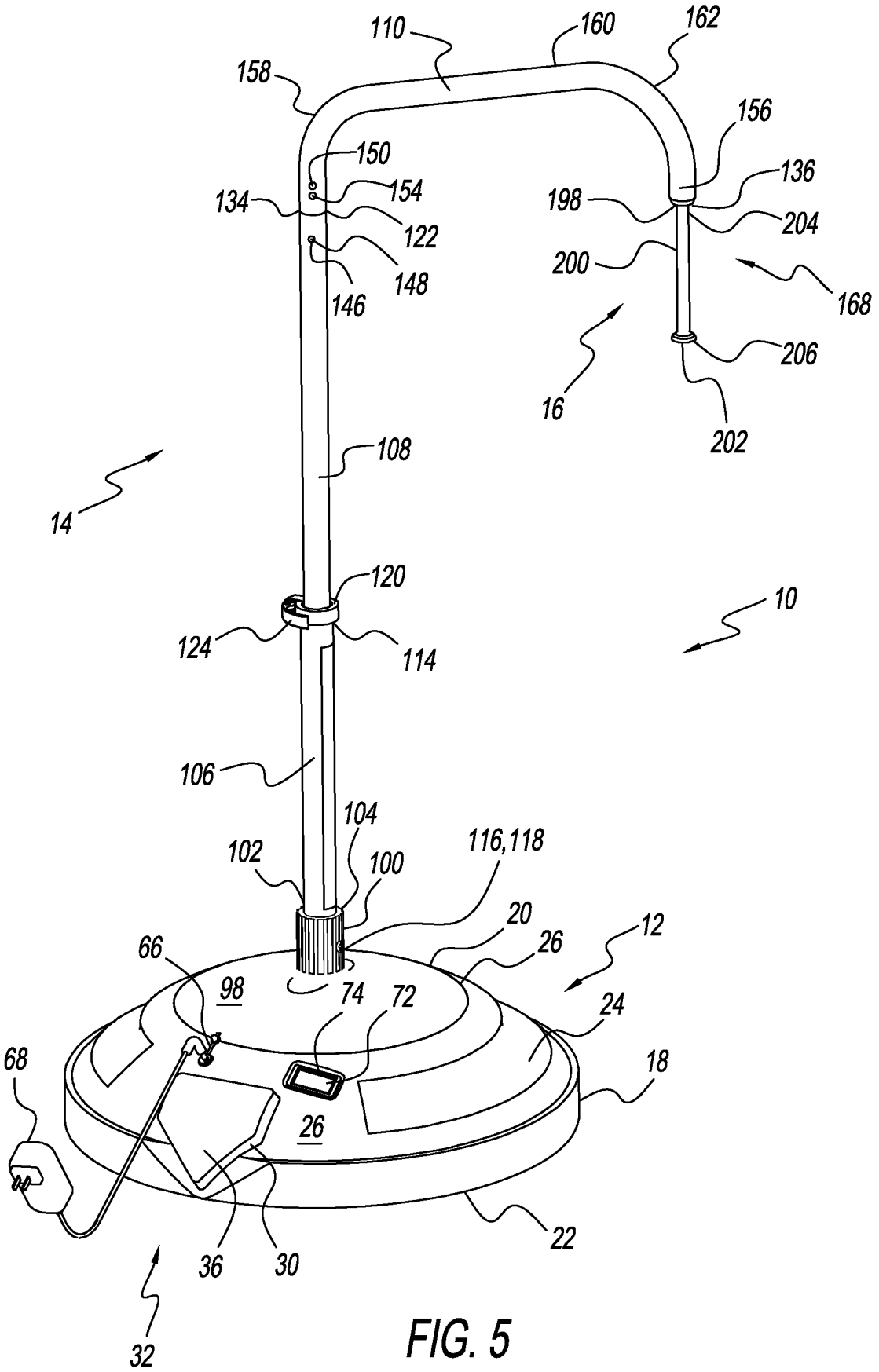
FIG. 5 is a perspective view of a bat swing training assembly.
Figure 6:
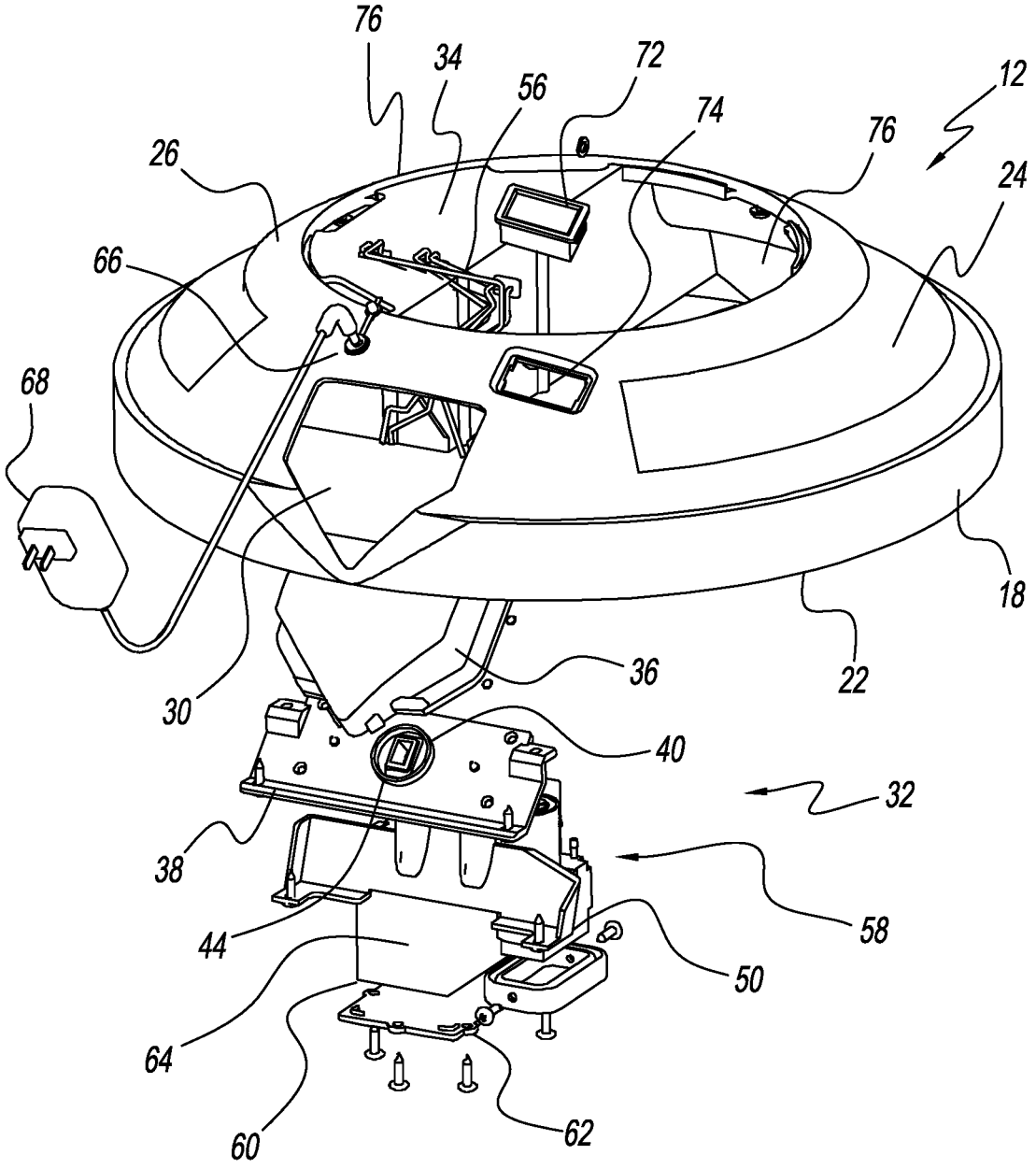
FIG. 6 is an exploded view of a bat swing training assembly.
Figure 7:
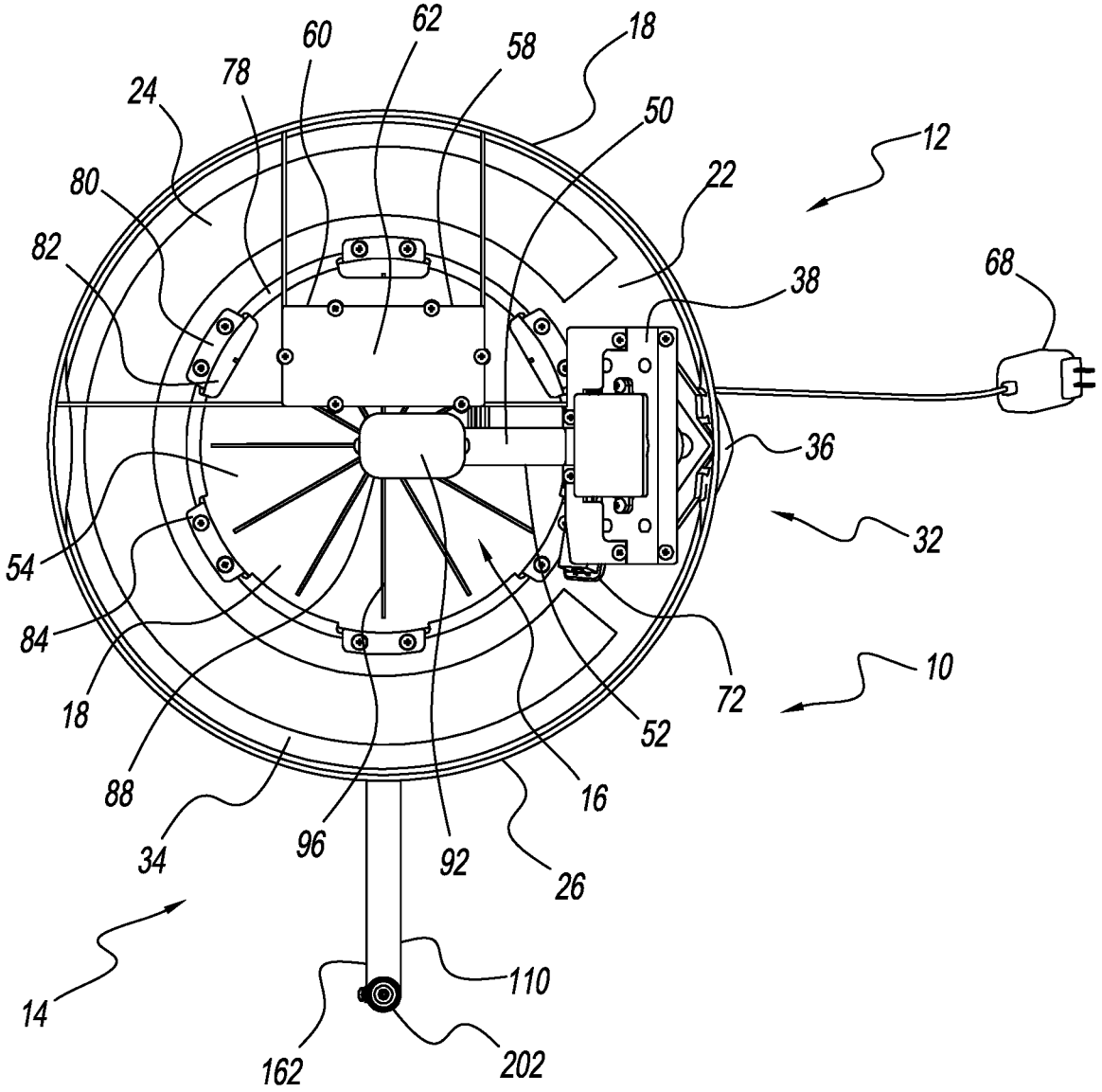
FIG. 7 is a bottom view of a bat swing training assembly.
Figure 8:
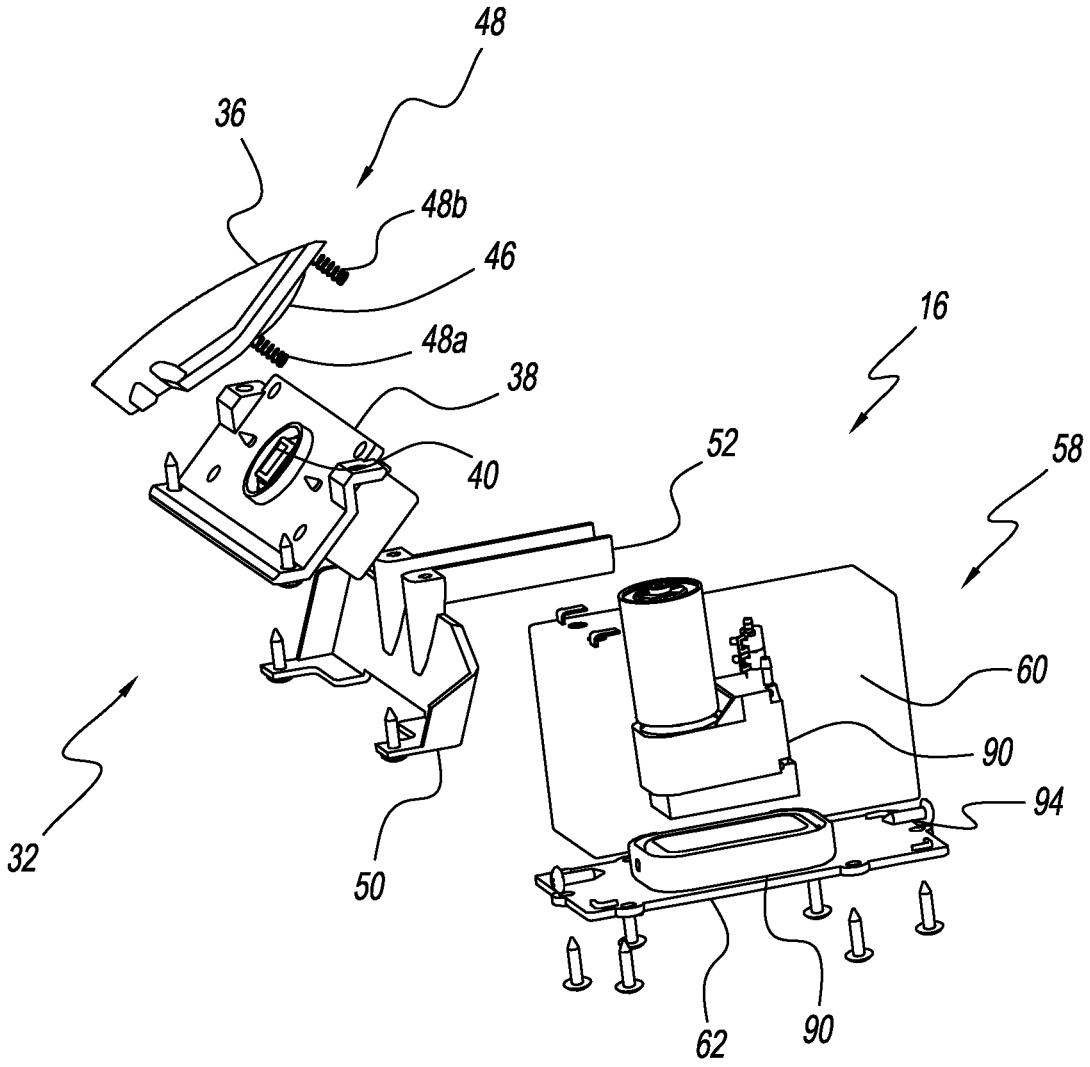
FIG. 8 is an exploded view of a bat swing training assembly.
Figure 9:
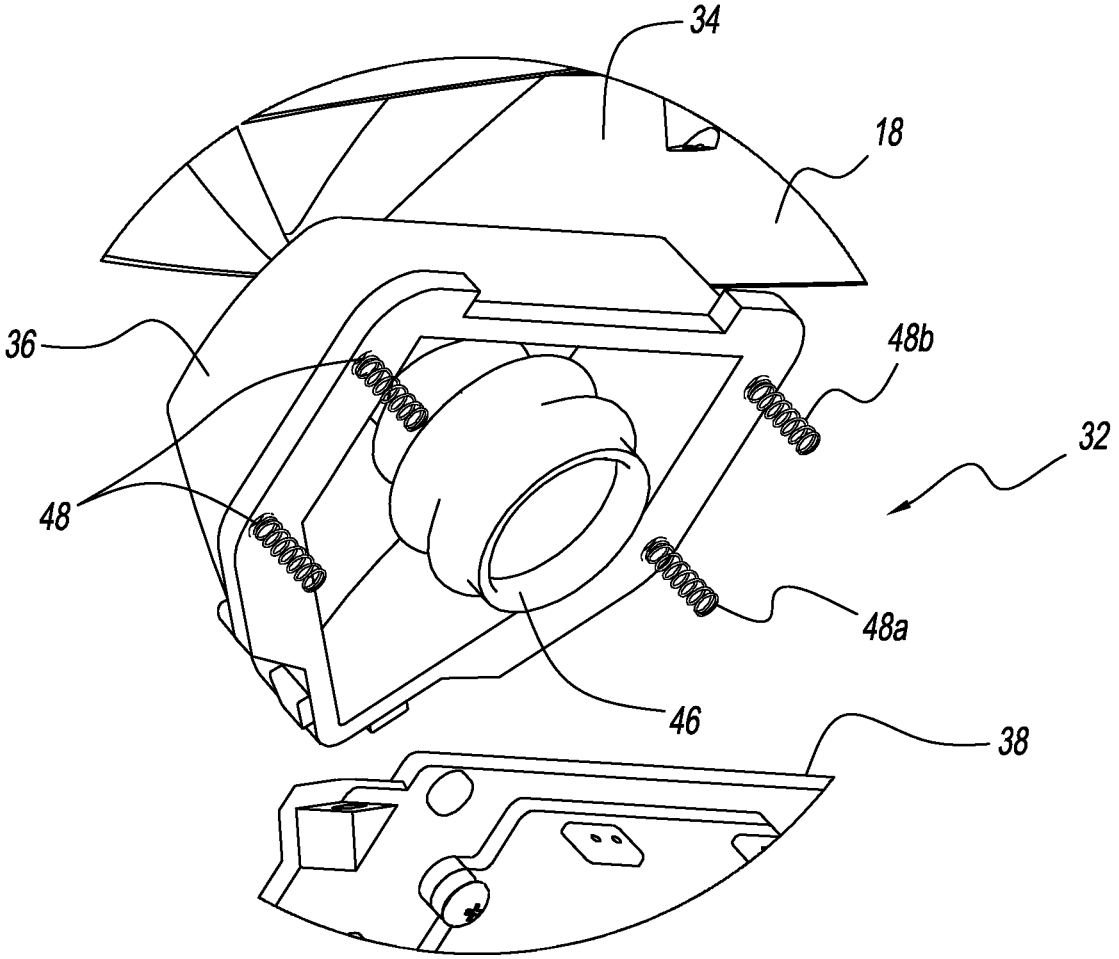
FIG. 9 is an exploded view of a bat swing training assembly.
Figure 10:
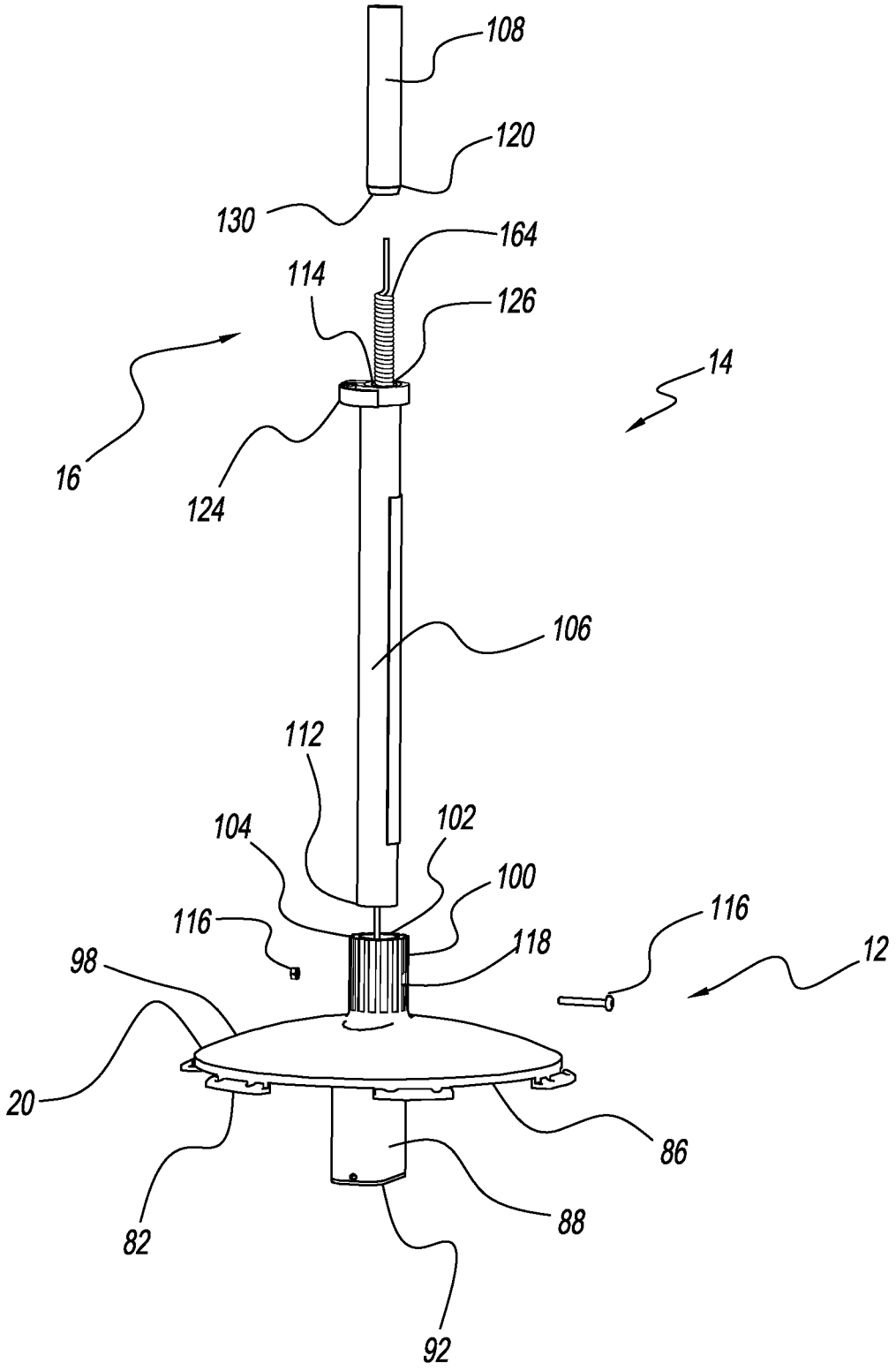
FIG. 10 is an exploded view of a bat swing training assembly.
Figure 11:
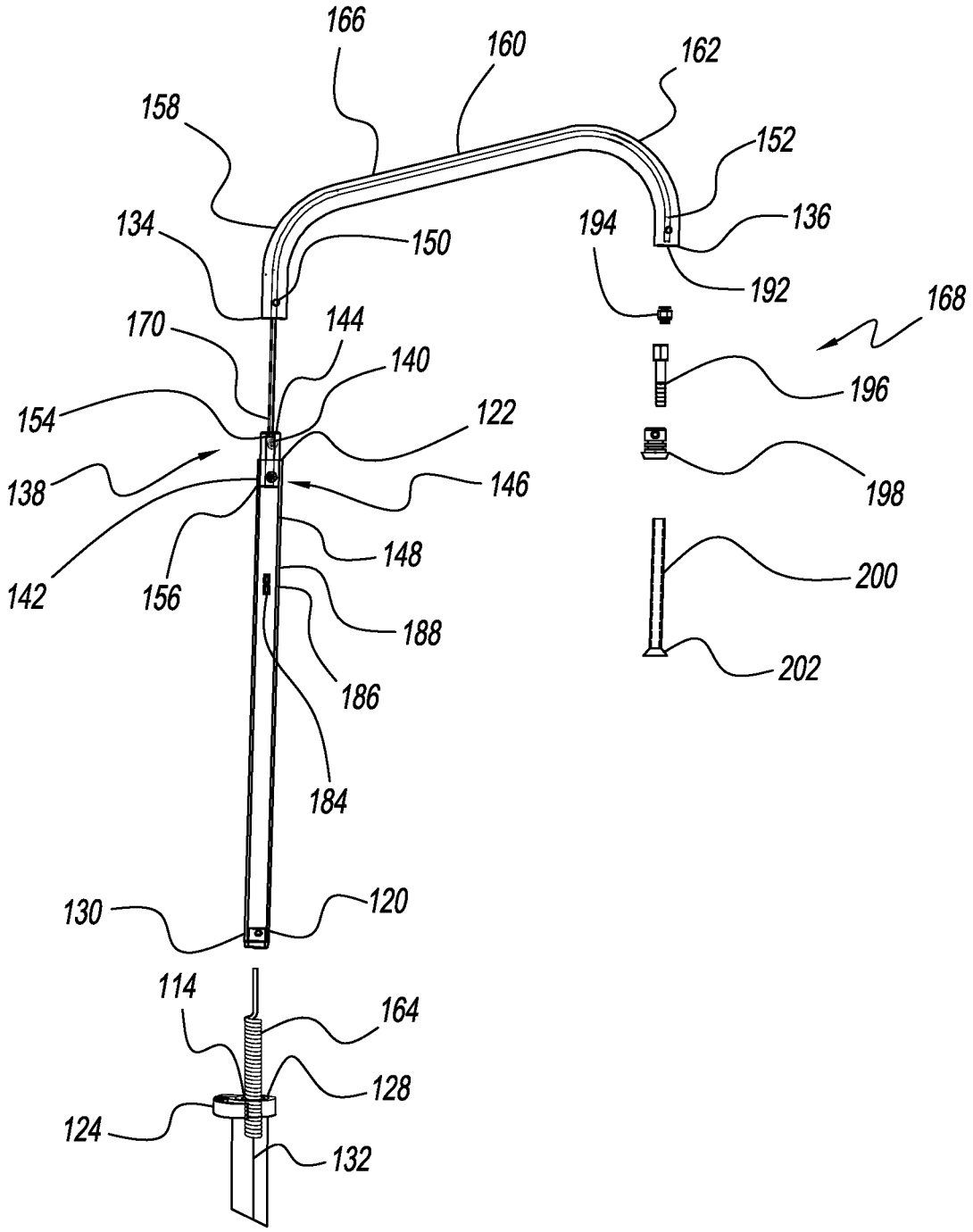
FIG. 11 is an exploded, partial sectional view of a bat swing training assembly.
Figure 12:
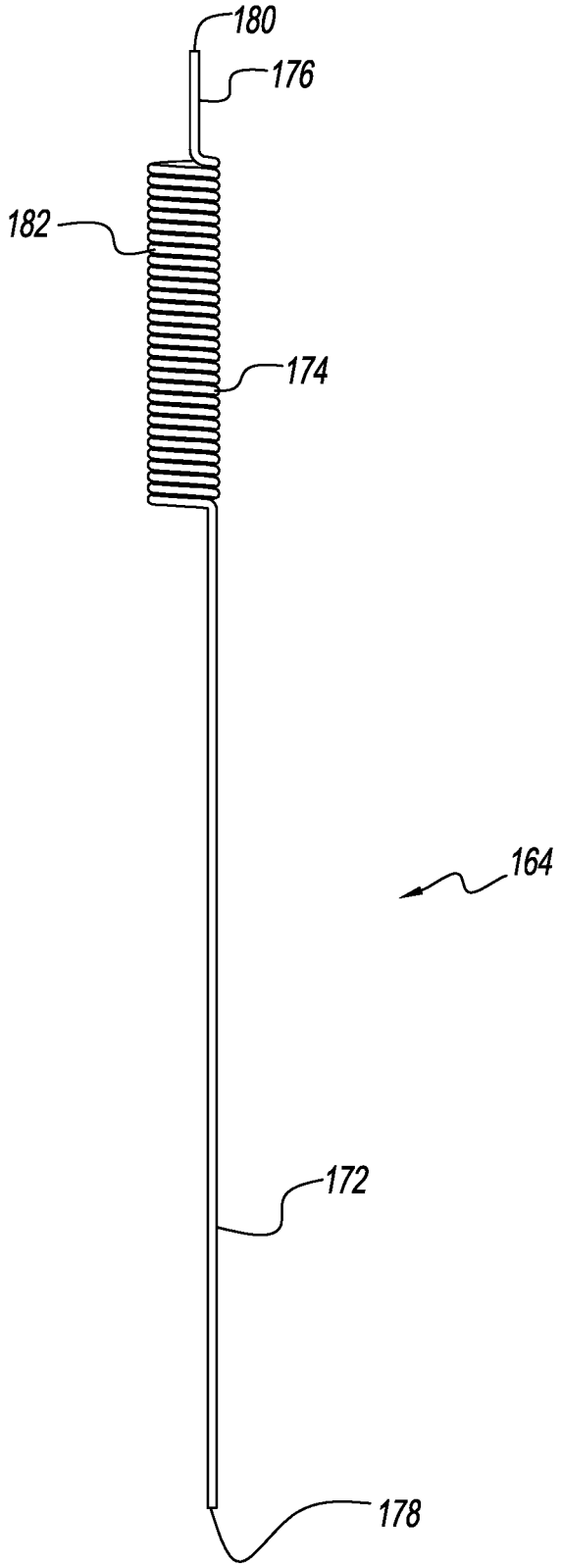
FIG. 12 is a side view of a coil hose of a bat swing training device.

With reference to the figures a bat swing training device 10 is shown having a base assembly 12, an arm or support member assembly 14, and a suction assembly 16.

The base assembly 12 may be of any size, shape, and structure. In some configurations, the base assembly 12 has a generally circular shape when viewed from the top and a conical or dome shape when viewed from the side. In such a configuration, the base assembly 12 has improved stability and is less likely to tip during use of the bat swing training device 10.

In some embodiments of the present invention, the base assembly 12 includes an outer base or overmold 18, an inner base or base cap 20, and, in some arrangements has an open bottom 22 that facilitates venting of the suction assembly 16 as further detailed herein. In some configurations the outer base 20 is made of a hard plastic, nylon, or nylon combined with acrylonitrile butadiene styrene (ABS) that provides rigidity to the outer base 20. The outer base in some arrangements is at least partially conical or dome like. The outer base 20 has a groove or slot 24 in an exterior surface 26 of the outer base 20 that provides a convenient location to store one or more ball such as a baseball, softball, or the like 28 (not shown) due to the size and shape of the groove 24. In some arrangements, the groove 24 extends around 75% or more of the outer base 18.

A switch opening 30 in the outer base 18 receives a switch assembly 32 that is mounted to an interior surface 34 of the outer base 18. The switch assembly 32 has a switch plate 36 positioned outside and exterior to the exterior surface 26 of the outer base 18 that is connected to a switch cover 38 positioned within and interior to the interior surface 34. The switch plate 36 is configured to be depressible such that at least a portion of the switch plate 36 comes into contact with a switch 40 that is configured to activate and deactivate the suction assembly 16.

In some embodiments, the switch plate 26 has a protrusion 42 that extends inwardly from the switch plate 26 towards the switch cover 38 and engages the switch 40 that in some arrangements is positioned within an opening 44 of the switch cover 38. In some configurations of the present invention, a baffle 46 encircles the protrusion 42 to guide the protrusion 42 to engagement with the switch 40 while simultaneously creating a buffer between the protrusion 42 and the switch 40 to avoid damage caused by contact between the protrusion 42 and switch 40. The switch cover 38 in some embodiments prevents external dust from entering the switch 40.

As seen in the exemplary embodiments, the switch plate 36 may have the appearance of a foot pedal due to its size, shape, and positioning, such as along a curvature of the outer base 18. In some embodiments, the switch plate 36 has a length between 120 mm (4.724") and 140 mm (5.512") and a width between 140 mm (5.512") and 160 mm (6.299"), which is thereby sized and shaped to direct an individual to use their foot due to the relatively large size of the switch plate 36.

In some arrangements of the present invention, the switch plate 36 is connected to the switch cover 38 by one or more compression springs 48. In particular embodiments, four springs 48 are used including a first set of springs 48A and a second set of springs 48B. The first set of springs 48A are positioned lower on the switch plate 36 and have a smaller length, for instance 27 mm (1.063"), in a natural state as compared to the second set of springs 48B that have a longer length, for example 30 mm (1.181"), in a natural state, which are positioned higher on the switch plate 36. In such a configuration, the switch plate 36 compresses in a curved fashion rather than a linear fashion that would occur if the compression springs 48 had equal lengths. In some arrangements, the switch plate 36 has a trapezoidal shape with the rectangular portion above the triangular portion, which not only resembles a baseball plate, but also suggests to an individual that the switch plate 36 depresses in a rotational arc rather linearly. In some variations of the present invention that utilize a trapezoidal shape, the first set of springs 48A are positioned in the lower corners of the trapezoidal shape and the second set of springs 48B are positioned in the upper corners of the trapezoidal shape. To reduce wear and scuffing on the cover plate 26 caused by shoes or cleats, the cover plate 26 in some embodiments is made of nylon.

Connected to the switch assembly 32 is a wire cover 50. The wire cover 50 has a channel 52 that extends inwardly into a cavity 54 of the base assembly 12. A wiring 56 of the bat swing training device 10 is retained in the channel 52 as the wiring 56 extends from the switch 40 to the suction assembly 16.

The wiring 56 is also connected to a battery assembly 58. The battery assembly 58 includes a battery housing 60 that is connected to or integrated with the outer base 18. The battery housing 60, in some embodiments, has a removable cover 62 that provides an individual access to one or more batteries 64 stored within the battery housing 60. Storage of the batteries 64 within a battery housing 60 that is connected directly to or monolithically integrated with the outer base 18 adds weight to the outer base 18, which in turn adds further stability to the bat swing training device 10. Further to this end, in some embodiments of the present invention, non-spillable lead acid batteries 64 are used because non-spillable lead acid batteries 64 are heavier than lithium batteries but are still rechargeable. Due to the weight of the base assembly 12, additional weights are not needed to hold the bat swing training device 10 in place.

The battery assembly 58 in some configurations also includes a charging port 66 that is positioned through the outer base 18 and is connected to the one or more batteries 64 by the wiring 56. The charging port 66 in some embodiments is a barrel plug charging port 66 that receives a removable charger 68 but other methods of recharging, such as an electrical outlet plug and wire 70 (not shown), are contemplated. Use of a removable charger 68 allows for the bat swing training device 10 to be placed anywhere without consideration to the location of a source of electricity external from the bat swing training device 10.

A battery indicator 72 is included in the battery assembly 58 in some embodiments. The battery indicator 72 is connected by the wiring 56 and provides the status or remaining charge of the one or more batteries 64. In some arrangements, the battery indicator 72 is positioned within an indicator opening 74 of the outer base 18.

The outer base 18 has an open top 76 that receives the inner base 20. In some embodiments, the inner base 20 connects to a receiver member or ring 78, which in some arrangements extends from a circumference of the open top 76 that has a circular shape. The receiver ring 78, as seen in the exemplary embodiments of the Figures, has a first plurality of flanges or tabs 80 that extend inwardly from the receiver ring 78. The inner base 20 in some arrangements has a second plurality of flanges or tabs 82 that are arranged to align with the first plurality of flanges 80. The first plurality of flanges 80 connects to the second plurality of flanges 82 for one or more fasteners 84. The one or more fasteners 84 in some embodiments are machine screws, which provide the unique benefit of avoiding pockets being formed in the inner base 20 during assembly.

The inner base 20 in some embodiments of the present invention has a durometer of approximately 80A to 85A, or in particular embodiments a durometer of 85A. At this hardness, the inner base 20 can absorb the force of an individual's contact with the ball 28 that is transferred through the bat swing training device 10 while being rigid enough to keep the arm assembly 14 upright. If the inner base 20 is harder, the bat swing training device 10 is less stable due to an inability to absorb force. In contrast, if the inner base 20 is softer, the inner base 20 will deform from the weight of the arm assembly 14 essentially causing the arm assembly 14 to at least partially collapse.

Connected to or monolithically integrated with an interior surface 86 the inner base 20 is a pump housing 88. A pump 90 of the suction assembly 16 is positioned within the pump housing 88 and connected to the wiring 56, which in turn allows electrical communication between the switch assembly 32, the battery assembly 58, and the suction assembly 16. By directly connecting or monolithically integrating the pump housing 88, vibration from pump 90 is absorbed by the inner base 18, which not only stabilizes the bat swing training device 10 but also deadening the sound of the pump 90 operating.

The pump housing 88 has a removable pump cover 92 that in some embodiments is made from the same material as the inner base 20 to further absorb vibration from the pump 90. Further to this end, some embodiments of the present invention have a pump buffer 94 removably or fixedly attached to the pump cover 92 to deaden the vibration and sound of the pump 90.

In some arrangements, a plurality of ribs 96 extend in an equidistantly radial arrangement from the interior surface 86 of the inner base 20. In some such arrangements, the plurality of ribs 96 do not include a rib 96 in a position that aligns with the wire cover 50, which facilitates assembly. The plurality of ribs 96 include eleven ribs 96. The plurality of ribs 96 provide the advantage of providing additional rigidity while permitting adequate flex in the inner base 20 as force is absorbed.

Extending from an exterior surface 98 of the inner base 20 is a neck or cylindrical member 100. In some embodiments, the neck 100 is directly connected or monolithically integrated with the inner base 20. The neck 100 has an opening 102 that extends from a top 104 of the neck 100, down through the neck 100, and into the pump housing 88 such that the pump 90 can apply a suction force through the opening 102.

Removably connected to the base assembly 12 is the arm assembly 14. In some embodiments of the present invention, the arm assembly 14 includes a first or lower hollow pole or tube 106, a second or middle hollow pole or tube 108, and a third or upper hollow pole or tube 110. While the present invention is being described with three tubes fewer or additional tubes are contemplated, and such arrangements would not depart from the spirit of the invention. In some configurations of the present invention, the tubes are made of aluminum, which reduces the overall weight of the bat swing training device 10 while not taking away from the stability provided by the weight of the base assembly 12.

The lower tube 106 extends from a first or bottom end 112 to a second or top end 114. The bottom end 112 of the lower tube 106 is received within the neck 100. In some embodiments, the lower tube 100 is secured within the neck by a neck fastener 116 that extends through an aligned neck opening 118 that extends from the neck 100 and the lower tube 106. In some embodiments, the outside diameter of the lower tube 106 is approximately 35 mm (1.378") while in other embodiments the outside diameter is 35.1 mm (1.382"). In such embodiments, the opening 102 of the neck 100 is 35.35 mm (1.392") or between 35.20 mm (1.386") and 35.50 mm (1.397"), which allows the tolerance between the respective diameters to be between 0.10 mm (0.004") and 0.25 mm (0.010"). In other arrangements, the diameters differ from those stated by the tolerance is maintained between 0.10 mm (0.004") and 0.25 mm (0.010"), which provides the unique benefit of permitting the assembly and operation of the bat swing training device 10 in cold and warm weather conditions. Although contemplated, diameters outside of this tolerance have the disadvantage of making assembly more difficult in cold conditions due to the constrictive relationship between the neck 100 and the lower tube 106. Conversely, tolerances above those stated have the disadvantage of permitting too much distance between the neck 100 and the lower tube 106, which results in the lower tube 106 moving about the opening 102 in the neck 100 instead of extending substantially vertically or vertically from the base assembly 12.

The middle tube 108 extends from a first or bottom end 120 to a second or top end 122. The bottom end 120 of the middle tube 108 is received within the lower tube 106 by way of the top end 114 of the lower tube. In some embodiments, the middle tube 108 has an external diameter of 28.58 mm (1.125") and the lower tube 106 has an internal diameter of 28.77 mm (1.132"), which leaves a space or tolerance between the lower tube 106 and middle tube 108 of approximately 0.12 mm (0.005"), which permits the middle tube 108 to slide substantially vertically or vertically along a height of the lower tube 106. In some arrangements, the middle tube 108 can be adjustably positioned to modify the overall height of the arm assembly 14. In some embodiments, the adjustable nature of the arm assembly 14 is such that a position of a centerline of the ball 28 is held between 26 inches (660.4 mm) and 38.5 inches (977.9 mm) from the ground. Tolerances below those stated make assembly difficult due to the need to precisely align the lower tube 106 and middle tube 108 during assembly and those above those stated have the disadvantage of the middle tube 108 having too much room for movement and makes securing the position of the middle tube 108 as described further herein thereby hindering the ability to adjust the arm assembly 14.

To secure the position of the middle tube 108, a clamp 124 is received around the lower tube 106 adjacent to or abutting the top end 114 of the lower tube 106. In some embodiments, the clamp 124 is a circular cam clamp, which makes operation of the clamp simple and expedient for securing and releasing the middle tube 108. The use of a clamp 124 is also possible due to the tolerances between the lower tube 106 and upper 108. In some arrangements, the tolerances discussed and the use of the clamp 124 does not prevent rotation of the middle tube 108, which is facilitated by the lower tube 106 being secured in a fixed position with the neck fastener 116.

In some embodiments of the present invention, a first or lower tubular plug 126 is received within the top end 114 of the lower tube 106. The first tubular plug 126 has an outwardly extending lip 128 that is sized and shaped to prevent the outwardly extending lip 128 from passing into the lower tube 106 thereby holding the first tubular plug 126 against the top end 114. The first tubular plug 126 is made of nylon, nylon combined with ABS, plastic, rubber, a combination of the foregoing, or other non-abrasive material such that contact between the middle tube 108 and the top end 114 of the lower tube 106 is prevented. Absent the first tubular plug 126, the edge of the lower tube 106 at the top end 114 would cut into the middle tube 108 if the middle tube 108 were rotated due to the clamp 124 squeezing the surfaces. In some configurations, the internal diameter of the lower tube 106 is turned down such that the internal diameter is increased to allow insertion of the first tubular plug 124 without reducing the internal diameter along the length of the lower tube 106.

To further protect the middle tube 108, a second or middle tubular plug 130 having an outwardly extending lip 132 is received in the bottom end 120 of the middle tube 108. The second tubular plug 130 is made of plastic, rubber, or other resilient material such that contact between the neck fastener 116 does not wear on the bottom end 120 when the middle tube 108 is received that far within the lower tube 106.

As seen in the exemplary embodiments, a relief or slit 132 is formed in the top end 114 of the lower tube 106. The space created by the relief 132 allows the top end 114 of the lower tube 106 to flex slightly without deforming when the force of the clamp 124 is applied to secure the position of the middle tube 108.

The upper tube 110 extends from a first or bottom end 134 to a second or top end 136. In some arrangements, the bottom end 134 of the upper tube 110 connects to the top end 122 of middle tube 108. In some embodiments, the upper tube 110 has an external diameter of 28.58 mm (1.125"), which prevents reception between the middle tube 108 and the upper 110 as each has the same external diameter. In some such embodiments, connection between the upper tube 110 and the middle tube 108 is accomplished by a tube splice member 138 received within both the upper tube 110 and the middle tube 108.

With references to exemplary embodiments of the Figures, the tube splice member 138 in a tubular structure having an external diameter substantially the same as that of the internal diameter of the middle tube 108 and the upper tube 110, e.g., approximately 0.20 mm (0.008"). As seen in the exemplary embodiments, the tube splice member 138 has a pair of holes 140 that extend from an exterior wall 142 of the tube splice member 138 inwardly to a central bore or opening 144 but not through the entire tube splice member 138. An upper hole 146 adjacent the top end 122 of the middle tube 108 is sized and shaped to align with one of the pair of holes 140 and receive a first shallow fastener 148 that is configured to secure connection between the middle tube 108 and the tube splice member 138 without extending into the central bore 144. Similarly, in some embodiments, the upper tube 110 has a first hole 150 adjacent the first end 134 and a second hole 152 adjacent the second end 136, which allows the upper tube 110 to be reversibly attached to the tube splice member 138 by aligning either the first hole 150 or the second hole 152 of the upper tube 110 with the other of the pair of holes 140 of the tube splice member 138 and inserting a second shallow fastener 154. The advantageous nature of being able to easily and simply reverse which end of upper tube 110 will be discussed further herein. In some embodiments, the tube splice member 138 is CNC (computer numerical control) cut with opposing tapered ends 156, which facilitate assembly due to the narrower diameter of the tube splice member 138 at the tapered ends 156.

The upper tube 110, in some embodiments, is configured to be reversible such that the upper tube 110 terminates at a different distance from the ground or base assembly 12 depending on the connection of the upper tube 110 with the middle tube 108. This is possible because the upper tube 110, has a first curved portion 158, a straight portion 160, and a second curved portion 162, which together form a generally upside-down-U shape.

For instance, in an exemplary raised arrangement, the first curved portion 158 extends vertically upwards from and abutting the middle tube 108 and then bends at an obtuse angle, such as an angle between 105° to 120°, which results in the upper tube 110 extending upwardly and away from the middle tube 108. The straight portion 160 extends linearly from the first curved portion 158, which increases the distance the elongated portion 160 is above ground or the base assembly 12 the further the elongated portion 160 extends from the first curved portion 158. The second curved portion 162 bends at an acute angle, such as an angle between 45° and 60°, and then extends vertically downwards.

Conversely, in an exemplary lowered arrangement, the second curved portion 162 extends vertically upwards from and abutting the middle tube 108 and then bends at an acute angle, such as an angle between 45° and 60°. The straight portion 160 extends linearly from the second curved portion 162, which decreases the distance the elongated portion 160 is above the ground or base assembly 12 the further the elongated portion 160 extends from the second curved portion 162. The first curved portion 158 bends at an obtuse angle, such as an angle between 105° to 120°, and then extends vertically downwards. In some arrangements, the difference between the raised arrangement and the lowered arrangement allows the upper tube 110 to terminate in a distance above the ground or base assembly 12 that can vary by approximately 6 (152.4 mm) to 7 inches (177.8 mm), and in other embodiments 6.75 inches (171.45 mm).

The suction assembly 16 in some embodiments of the present invention includes the pump 90, a coil hose 164, an upper hose 166, and a nozzle assembly 168. Although any suitable pump 90 is contemplated, in some embodiments a standard 12V pump 90 is used having a rating of 15±1 inches (381.00 mm±25.4 mm) of mercury as higher pressure pumps provide too much suction, which prevents a ball 28 from being released or releasing properly, and lower pressure pumps provide too little suction to hold balls 28.

The pump 90 has a port 170 that receives or otherwise connects the pump 90 to the coil hose 164. The coil hose 164 has a first elongated portion 172 that extends to a coiled portion 174 that extends a second elongated portion 176 between a first end 178 and a second end 180. The coiled portion 174 is formed such that the coil hose 164 follows a coiled path along the coiled portion 174 (contra spring hose). The coil hose 164 provides the unique advantage of permitting the arm assembly 14 to be raised and lowered without disassembling the suction assembly 16 as a plurality of coils 182 of the coiled portion 174 can expand and retract as needed to extend the length from the pump 90 to or adjacent to the top end 122 of the middle tube 108.

In some embodiments, the coil hose 164 has the following properties

TABLE 1-1

| | |
|---|---|
| Overall Coil Hose Length | 620 mm |
| First Elongated Portion Length | 445 mm |
| Second Elongated Portion Length | 40 mm |
| Coil Hose Internal Diameter | 2.36 mm |
| Coil Hose External Diameter | 4.0 mm |
| Coil Portion Diameter | 16 mm |
| Number of Coils | 30 coils |

From Table 1-1 many advantages are achieved, including: a length of a first elongated portion 172 that does not collapse or tangle when the arm assembly 14 is in a lowered arrangement; and a diameter of the coiled portion permits free movement within the arm assembly 14 without tangling or excessive contortion result in increased rubbing; an overall length and internal diameter that does not collapse but provides sufficient suction to hold a ball 28. Similar embodiments of a coil hose 164 are contemplated, including those having: a length of a first elongated portion 172 that does not collapse or tangle when the arm assembly 14 is in a lowered arrangement; a coil hose 174 that does not bind, pinch, collapse, or entangle as the arm assembly 14 is turned during operation unless the number of turns exceeds twenty turns; a diameter of the coiled portion permits free movement within the arm assembly 14 without tangling or excessive contortion that increasing rubbing against the arm assembly 14; an overall length and internal diameter that does not collapse but provides sufficient suction to hold a ball 28.

The second end 180 of the coil hose 164 is connected to and received within a first end 184 of a push or tube union fitting 186, which in some embodiments is made of plastic to reduce the wear on both the push union fitting 186 and the arm assembly 14. Connected to a second end 188 of the push union fitting is a first end 190 of the upper hose 166, which extends to a second end 192.

The upper hose 166, in some arrangements, has a larger internal diameter in relation to the internal diameter of the coil hose 164. In particular embodiments, the internal diameter of the upper hose 166 is 3.18 mm (0.125") and the external diameter is 6.0 mm (0.236"). In some instances of the present invention, the length of the upper hose 166 is 780 mm (30.710"). The overall length of the upper hose 166 combined with larger internal diameter of the upper hose 166 increases the suction volume of the suction assembly 16.

The second end 192 of the upper hose 166 connects to the nozzle assembly 168. The nozzle assembly 168 in some iterations of the present invention has an upper arm or hose to barb insert 194, a threaded barb fitting 196, an insert plug 198, and a nozzle 200 having a suction cup 202. With reference to the Figures depicting exemplary embodiments, the second end 192 of the upper hose 166 is received in one end of the hose to barb insert 194. Threadably received and connected on the opposing end of the hose to barb insert 194 is the threaded barb fitting 196. The threaded barb fitting 196 extends through the insert plug 198 and receives a first end 204 of the nozzle 200 in a friction fit engagement. During assembly of the bat swing training device 10, described further herein, the insert plug 198 is received in terminal end (either the first end 134 of the second end 136) of the upper tube 110, depending on the desired arrangement of the upper tube 110 to achieve the desired height of the arm assembly 14. The insert plug 198 retains the nozzle assembly 168 in place.

The nozzle 200 extends from the first end 204 to the suction cup 202 to a second end 206. In some embodiments, the nozzle 200 and suction cup 202 are monolithically integrated such that a uniform body is formed, which reduces manufacturing costs, reduces assembly time of the nozzle assembly 168, and makes replacement of the nozzle 200 simpler and easier. In some arrangements, the nozzle 200 from the first end 204 to the second end 206 has a length approximately 158 mm (6.220") or 158.59 mm (6.244"), which provides the unique benefit of positioning the ball 28 held by the suction cup 202 at a distance that provides a special orientation to an individual that makes it highly unlikely that a swing from the individual will hit the arm assembly 14 as individuals typically swing low and the length of the nozzle 200 is such that even a high swing will almost always result in contact with the nozzle 200 only and not the arm assembly 14. At shorter distances, an individual has a higher probability of hitting the arm assembly 14, which could cause significant damage to the bat swing training device 10.

The internal diameter of the nozzle 200, in some embodiments, between the first end 204 and the suction cup 202 is approximately 8 mm (0.314") or 7.94 mm (0.313") and the external diameter is approximately 13 mm (0.512") or 13.02 mm (0.513"). In these and other embodiments, the internal diameter of the nozzle 200 in comparison to the upper hose 166 further increases suction volume.

The suction cup 202 flares outwardly from the rest of the nozzle 200 and in some arrangements has a width of approximately the size of a quarter and in others has a diameter of 26.73. The height of the suction cup 202 in some embodiments is approximately 8 mm (0.315") to 9 mm (0.354") but in some configurations the suction cup is 8.60 mm (0.339"). The suction cup 202 in some embodiments, including those stated, cover approximately 2% to 4% of a regulation softball 28 and 3% to 5% of a regulation baseball 28, which provides the unique benefit of limiting the portion of the ball 28 that is obscured from view, which facilitates improvement of an individual's swing mechanics. Although the suction cup 202 covering less than 25% of a regulation baseball 28 is contemplated, at sizes larger than particular sizes stated, the suction cup 202 provides too much hold or suction on the ball 28, which although functional will result in the ball 28 taking flight in an unnatural pattern that can incorrectly suggest to an individual that their swing mechanic is incorrect. Conversely, at sizes smaller than those stated, the suction cup 202 will not be able to hold as wide of a range of ball 28 types, sizes, surface conditions, and finishes.

In some configurations of the present invention, the nozzle 200 has a durometer between 55 and 65, and still others has a durometer of 60. At these durometers, the nozzle 200 is capable of providing adequate suction to hold a variety of balls 28 in position while allowing the ball 28 to be released with minimal contact, such as a light tap of finger against the ball 28. At durometers harder than those stated, the suction cup 202 will not sufficiently flex against the surface of a ball 28 resulting in insufficient contact between the suction cup 202 and the ball 28 and excessive bleed of the suction pressure needed to hold the ball 28 in place. This is especially true given that the curvature, size, finish, and wear varies between balls 28 thereby requiring the suction cup 202 to conform to a variety of ball 28 conditions. Additionally, at harder durometers, the nozzle 200 will be more easily damaged and wear will increase due to the rigidity of the nozzle 200, which in turn will increase the force transferred to the rest of the bat swing training device 10 that will cause instability and wear. At durometers below those stated, the nozzle 200 will have insufficient bleed resulting in the ball 28 being held too tightly by the suction cup 202 and thereby hindering the natural flight pattern of the ball 28. Additionally, lower durometers cause the nozzle 200 to collapse at least partially, which although operational, is not only aesthetically displeasing but can also reduce the functional life of the nozzle 200.

To assemble the bat swing training device 10, the switch assembly 32 is attached to the outer base 18 as is the battery assembly 58. The pump 90 is placed in the pump housing 88 of the inner base 20 and wiring 56 is connected to the switch assembly 32, battery assembly, and pump 90 such that each are in electrical communication. The inner base 20 is then mounted or connected to the receiver ring 78 of the outer base 18.

The coil hose 164 is connected to the port 170 of the pump 90 at the first end 178 and the push union fitting 186 at the second end 180 of the coil hose 164. Then the coil hose 164 is passed through the opening 102 in the neck 100 of the inner base 20. Next, the lower tube 106 is inserted into the neck 100 with the coil hose 164 being passed up and through the lower tube 106. The middle tube 108 is then inserted into the lower tube 106 with the coil hose 164 being passed up and through the middle tube 108. In some embodiments, the structure of the coil hose 164 include the coiled portion 174 will naturally cause the coil hose 164 to hold a position such that push union fitting 186 naturally rests approximately level with the top end 122 of the middle tube 108. Using the push union fitting 186, the coil hose 164 is then pulled and extended to hang outside of the middle tube 109. The neck fastener 116 is then inserted into the aligned opening 118 of the neck 100 and the lower tube 106 to secure the lower tube 108 in place. In some embodiments, the middle tube 108 must be raised slightly vertically to allow the neck fastener 116 to pass through the lower tube 106. The clamp 124 is then passed over the coil hose 164, the middle tube 108, and the top end 114 of the lower tube 106 and secured in place such as by use of a cam arm.

The upper hose 166 is passed through the upper tube 110 and secured in place with the upper tube 110 by connection with the insert plug 198 at either the first end 134 or second end 136 of the upper tube 110 depending on the arrangement (raised or lowered) of the upper tube 110. The nozzle 200 is connected to the threaded barb fitting 196 of the nozzle assembly 168.

Once connected to the upper tube 110, the upper hose 166 including the first end 190 of the upper hose 166 extends outside whichever end, the first end 134 or the second end 136, which is not occupied by the nozzle assembly 168. The upper tube 110, starting with the first end 190 is then passed through the tube splice member 138. The tube splice member 138 is then passed over the upper hose 166 and inserted into the upper arm 110 until the second shallow fastener 154 can pass through and connect to one of the pair of holes 140.

The upper hose 166 is then connected to the second end 188 of the push union fitting 186. At this point, the suction force of the suction assembly 16 is in communication from the pump 90 to the suction cup 202 of the nozzle 200 if the pump 90 were activated. To complete assembly of the arm assembly 14, the tube splice member 138 is inserted into the middle tube 108 and secured in place with the first shallow fastener 148 being positioned through the middle tube 108 and into one of the pair of holes 140 of the tube splice member 138. If needed, the batteries 64 are charged by connecting the removable charger 68 to a source of electricity 208 (not shown) and to the charging port 66—the status of which will be updated on the battery indicator 72.

In operation, an individual releases the clamp 124 to allow the middle tube 108 to be moved to a desired vertical position and if needed the upper tube 110 is reversed as described above to increase or decrease the vertical position of the arm assembly 14 as well as that of the suction cup 202 of the nozzle 200. The individual can also rotate the middle tube 108 to change the direction in which the upper tube 110 extends away from and in relation to the base assembly 12, which consequently also alters the position of the suction cup 202 of the nozzle 200. Once the desired position is achieved, the clamp 124 is closed to hold the position of the arm assembly 14. The position of the arm assembly 14 can be altered both rotationally and vertically without disconnecting the suction assembly 16.

The individual then activates the suction assembly 16 by depressing the switch plate 36, which in some instances is accomplished by pressing the switch plate 26 with a foot of the individual. Once the pump 90 is activated, suction force from the pump is communicated to the nozzle 200 with the pump 90 venting from the base assembly 12. A ball 28 is the put into contact with the suction cup 202, which holds the ball 28 in place using the suction force of the pump 90. As detailed herein, the amount of suction force of the present invention allows the ball 28 to be removed from the suction cup 202 and the suction force of the pump 90 with minimal impact. When an individual swings at the ball 28, with a focus on striking the ball 28 in the lower third, the ball 28 is released from the suction cup 200 without the suction force inhibiting the natural flight path of the ball 28 that would result from the ball being struck in the same position without interference from an outside device. Additionally, the position of the arm assembly 14 and suction assembly 16 allows the ball 28 to be held in place without obscuring the lower third of the ball 28 such that swinging mechanics can be practiced without interference from the bat swing training device.

Therefore, a bat swing training device 10 has been provided that provides a ball position and orientation that is stationary and almost completely visible, develops proper swing mechanics, functions the same with various ball types, materials, wear, and finishes, permits the position and orientation of the ball to be changed quickly and without disassembling the device, allows a ball to follow a natural flight path when hit from the device, allows cleaner contact with a ball, is portable and operates in a standalone fashion, is stable and does not require weights to hold the base assembly in place, and improves upon the art.

From the above discussion and accompanying figures and claims it will be appreciated that the bat swing training device 10 offers many advantages over the prior art. It will be appreciated further by those skilled in the art that various other modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A bat swing training device comprising:

a base assembly having an outer base with a generally circular shape and an open top with a receiver ring having a first plurality of flanges extending inwardly from the open top and an inner ring having a second plurality of flanges that align with and connect to the first plurality of flanges;

the inner base having a pump housing, a neck with an opening that extends from a top of the neck into the pump housing, a plurality of ribs extending outwardly from the neck in a radial arrangement along an interior surface of the inner base, and a durometer of approximately 85A;

the outer base having a battery housing, a switch opening and a switch assembly mounted to an interior surface positioned within the switch opening such that a switch plate of the switch assembly is at least partially positioned outside an exterior surface of the outer base, and a material harder than the inner base;

the switch assembly has a first set of springs and second set of springs connected to the switch plate and wherein the first set of springs have a length that is less of the second set of springs such that wherein when the switch plate is pressed the switch plate compresses in an arc;

the base assembly connected to an arm assembly having a middle tube and an upper tube that are connected by a tube splice member and a first shallow fastener received through the middle tube and the tube splice member without the first shallow fastener entering into a central bore of the tube splice member and a second shallow fastener received through the upper tube and the tube splice member without the second shallow fastener entering into a central bore of the tube splice member;

the middle tube having a relief formed in a top end of the middle tube and a clamp received over the top end, wherein the relief is configured to prevent the middle from deforming when the clamp is clamped on the middle tube;

a suction assembly connected to the base assembly and the arm assembly; and the suction assembly connected to a pump and a push union fitting connecting a coil hose and an upper hose, and a nozzle assembly connected to the upper hose and having a nozzle with a durometer between 55A and 65A and a length of approximately 158 mm;

the coil hose having a length of 620 mm a first elongated portion, a coiled portion having exactly coils and positioned 445 mm above the connection of the coiled portion to the pump and a second elongated portion; and the nozzle having a suction cup with a diameter that covers between 3% to 5% of a regulation baseball wherein when in contact with the regulation baseball;

wherein the suction assembly is configured to hold a ball in a stationary position.

* * * * *